United States Patent [19]

Bemiss

[11] 4,304,335

[45] Dec. 8, 1981

[54] PAPERBOARD CONTAINER FOR BAKING

[75] Inventor: Robert P. Bemiss, Hillsborough, Calif.

[73] Assignee: Johns-Manville Corporation, Denver, Colo.

[21] Appl. No.: 157,365

[22] Filed: Jun. 9, 1980

[51] Int. Cl.[3] ..... B65D 43/02

[52] U.S. Cl. ..... 206/607; 206/608; 206/633; 229/43

[58] Field of Search ..... 206/634, 633, 625, 626, 206/627, 602, 607, 608, 634; 229/32, 43

[56] References Cited

U.S. PATENT DOCUMENTS

| | | | |
|---|---|---|---|
| 1,672,884 | 6/1928 | Gimgnas | 206/627 X |
| 1,975,444 | 10/1934 | Block | 229/43 |
| 2,114,134 | 4/1938 | Weiss | 206/626 X |
| 2,658,664 | 11/1953 | Hennessey | 229/43 |
| 2,679,349 | 5/1954 | Mullinix | 206/607 X |
| 3,002,674 | 10/1961 | Wright | 206/604 |
| 3,049,283 | 8/1962 | Buttery | 229/43 |
| 3,163,351 | 12/1964 | Borgardt | 206/634 X |
| 3,193,174 | 7/1965 | Glasband et al. | 229/31 R X |
| 3,195,796 | 7/1965 | Buttery | 206/626 X |
| 3,263,900 | 8/1966 | Link et al. | 206/607 |
| 3,298,596 | 1/1967 | Tolaas et al. | 206/608 |
| 3,349,985 | 10/1967 | Salway | 206/633 |
| 3,567,106 | 3/1971 | Anderson | 229/31 R |
| 3,904,104 | 9/1975 | Kane | 229/31 R X |
| 3,907,774 | 7/1976 | Quenner | 229/620 |

*Primary Examiner*—Herbert F. Ross

*Attorney, Agent, or Firm*—Robert M. Krone; Joseph J. Kelly; Norvell E. Von Behren

[57] ABSTRACT

A paperboard carton formed of a tray with a top fitting thereover. The top has tabs formed in opposing side panels preferably by locating spaced tear lines, which tabs can be glued to the tray to hold the top in place. The top is removed from the tray by pulling the tabs outward and upward.

4 Claims, 7 Drawing Figures

PAPERBOARD CONTAINER FOR BAKING

BACKGROUND OF THE INVENTION

Figure 1:
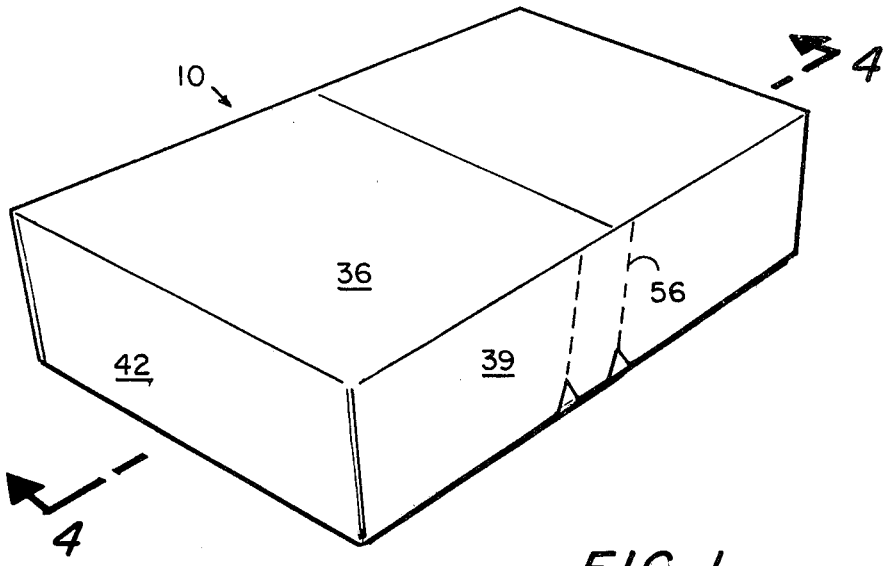
FIG. 1 shows a carton incorporating the subject invention.

Paperboard for the manufacture of paperboard cartons is now being made to withstand oven baking temperatures without burning or scorching. Such cartons can now be opened and placed directly into the oven for cooking the enclosed food. Frequently the ingredients cannot be mixed prior to the time of cooking or other ingredients must be mixed with the carton contents prior to cooking.

For instance in selling the ingredients for baking a cake, the components usually are separately packaged in plastic bags. Prior to baking the ingredients must be mixed together along with water or milk and possibly other products before baking. Additionally there is the need to form the container in which the baking is done in a manner to allow the baked product to be removed. Most baking tins have at least some of the side walls tapered outward at the top so that the cake will be released. Another purpose of the two tapered side walls is to formfit the top to keep close contact of the cover to the tray side wall inasmuch as the end walls are not glued to the tray. The end walls are not tapered as is customary to display this type of product standing on the end similar to the display of cereal cartons.

The carton as sold in the store must be sufficiently sealed to prevent leakage of the contents and to prevent pilferage. Of course if the contents are enclosed in individual bags, tight sealing is not necessary but at least the top must be fixed to the tray to prevent spillage. If a tearout top is provided, the complete top center must be removed so that the baked product can rise and be taken out. On the other hand if a removable top is used, the top must be sufficiently sealed to the tray to maintain the contents intact prior to baking and also in a manner to allow removal of the top without damaging the tray to be used for the subsequent baking. Additionally it is desirable that the tray maintain a satisfactory appearance so that the product could be served in it after baking if desired.

It is the purpose of the present invention to provide a paperboard container made of a tray and top suitable for holding the contents such as those used in baking cakes and the like, yet wherein the top which can be separated from the tray in a satisfactory manner to allow removal and mixing of the baking contents without damage to the tray to be used for subsequent baking and possible serving.

SUMMARY OF THE INVENTION

A paperboard carton comprising a tray having a bottom panel and upstanding side and end walls to form an open top container, a top for covering the tray comprising a top panel and downwardly extending side panels and end panels positioned to abut the walls of the tray. At least two of the top side panels include tabs formed by spaced tear lines, which tabs are glued to the adjacent tray walls. The top is removed from the tray by pulling the tabs outward and upward. This allows the top to be hinged upward at a score line for removal by releasing the inward tapered side panels.

DESCRIPTION OF THE INVENTION

In FIG. 1 is shown a carton 10 formed of a tray 11 to which is attached a top 12. The overall purpose of this paperboard carton is to permit removal of the top without damaging the tray such that the tray can be used subsequently for mixing and preferably for baking or otherwise cooking the carton contents. The specific carton shown is designed for marketing and baking cakes and the like.

The tray 11 is designed primarily for baking purposes. The paperboard is ovenproof, that is it will withstand baking temperatures without burning or charring. In this preferred embodiment two sides of the tray are tapered outward at the top to allow easy release of a baked product such as a cake. Thus the baking is done directly in the tray. Usually such cartons have the ingredients (not shown) separately packaged in plastic bags which ingredients must be mixed together and with other substances prior to baking.

Figure 6:
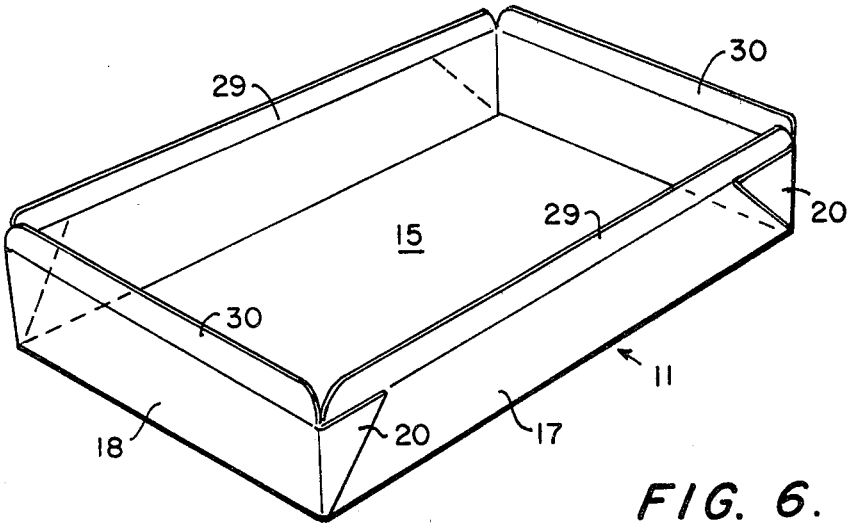
FIG. 6 shows the carton tray.
Figure 7:
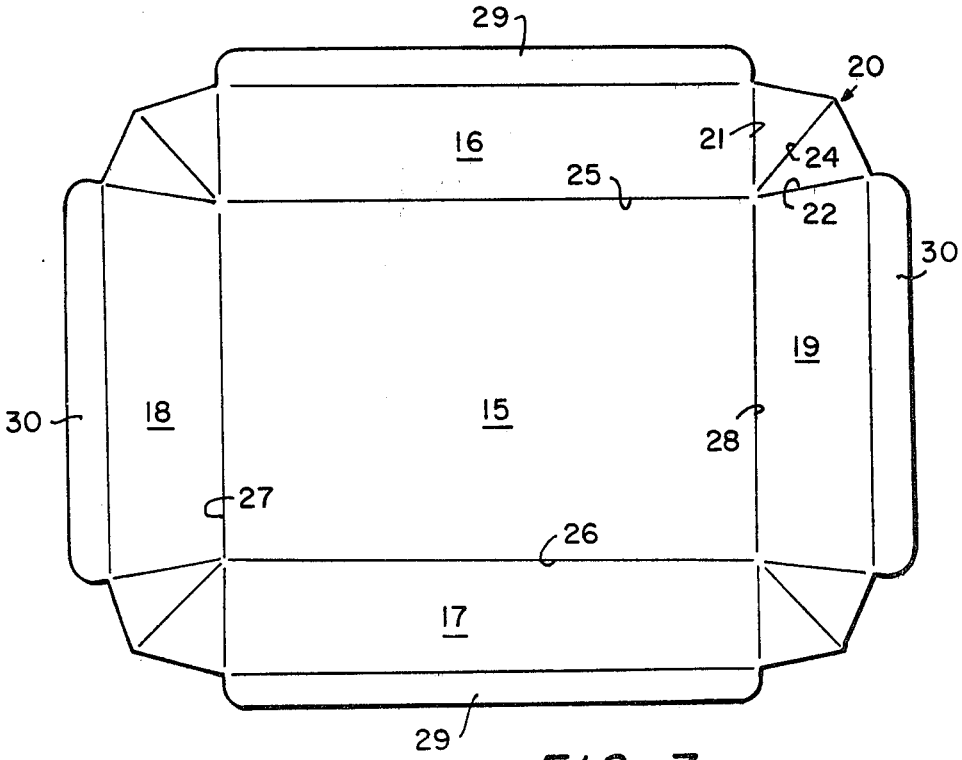
FIG. 7 shows the blank from which the tray is made.

For this purpose the tray is formed form the blank shown in FIG. 7 comprising a bottom panel 15, side panels 16 and 17 and end panels 18 and 19. The adjacent ends of the side and end panels are joined by gussets 20, each connected to the side panel by a fold line 21 and to the end panel by a fold line 22. A center fold line 24 permits the bending of the gusset in this instance to the outside of the side panel as shown in FIG. 6.

The side panels 16 and 17 are connected to the bottom panel by fold lines 25 and 26 while the end panels are so connected by fold lines 27 and 28, respectively. The carton is formed by folding the side and end panels at right angles to the bottom panel and bending the gussets along the outside of the adjacent side panel in the manner shown in FIG. 6. The fold line 22 of the gusset does not extend at right angles to the fold line 28, thereby causing the tops of the side panels 16 and 17 to be tapered outward from the bottom panel 15. When the gusset is pressed into contact with the adjacent side panel, glue thereon sets to hold the tray in the folded attitude. The resulting tray is formed with the upper extending edges of the side walls forming a greater area than the area of the bottom panel 15, i.e. the side walls are tapered outward. The end walls preferably are folded normal to the bottom panel to permit stacking of the tray on edge for easy storage.

Attached to the extending edges of the side and end panels are flaps 29 and 30, respectively. These flaps are folded inward prior to the top being placed over the tray and serve two purposes. Firstly the flaps tend to seal between the tray and the top. Secondly the flaps can be bent outward prior to loading the ingredients for baking to stiffen the top edge to prevent bulging as the cake rises. The flaps in the folded down position allow for a smaller container prior to opening.

Figure 5:
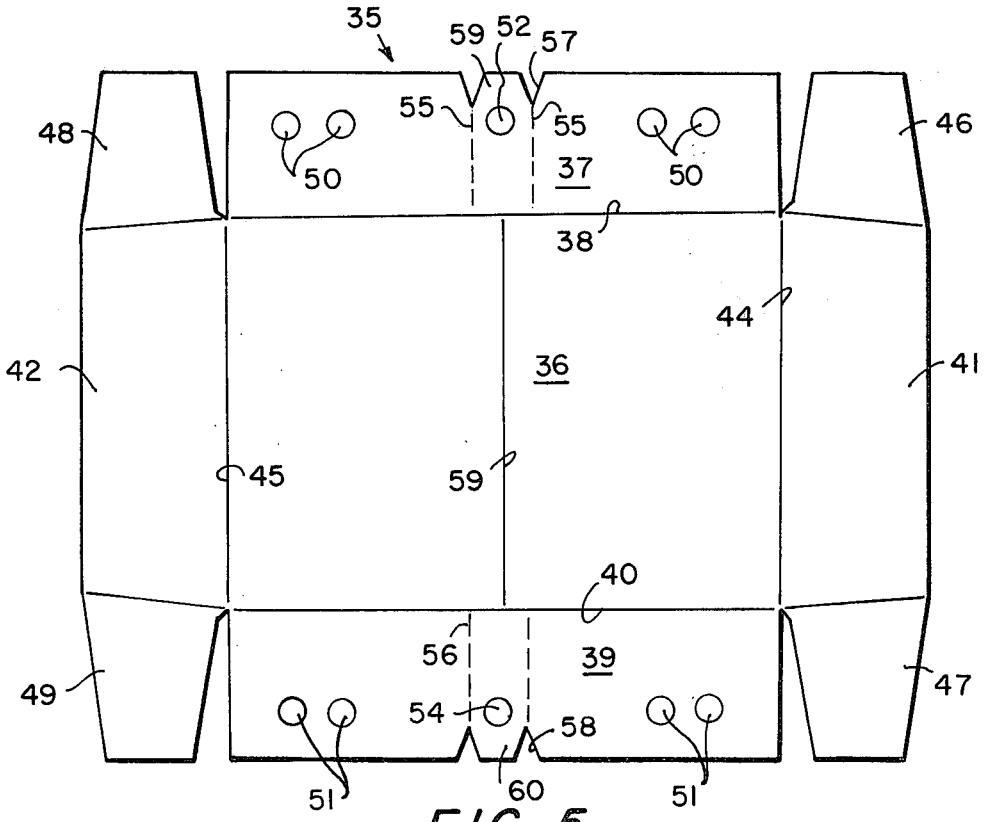
FIG. 5 shows the blank from which the carton top is made.

Turning now to the formation of the top, the top blank 35 shown in FIG. 5 comprises a top center panel 36 having attached thereto the side panel 37 at the fold line 38, the side panel 39 at the fold line 40 and the end panels 41 and 42 at the fold lines 44 and 45, respectively. The side and end panels are approximately the same size as the side and end walls of the tray and are positioned to fit against the respective tray walls when the top center panel 36 is placed over the top of the carton.

The carton is formed by placing the top center panel 36 in alignment with the top of the carton tray and bending the end panels 41 and 42 down alongside the adjacent tray walls 18 and 19. Thereafter the corner flaps 46 and 47 attached to the end wall 41 and the corner flaps 48 and 49 attached to the end wall 42 are bent normal to the supporting end panel and alongside the adjacent side panel of the tray. Previously glue is deposited on the bottom side of the side panels at the spots 50 on the side panel 37 and the spots 51 on the side panel 39. With the subsequent bending of the side panels downward along the side wall of the tray, these glue spots contact the adjacent corner flap and hold the top in this formed position. Similarly glue spots 52 and 54 are deposited on the side flaps 37 and 39 preferably near the center. These glue spots contact the tray side wall and hold the top side panel into close engagement with the tray side wall. This fixes the top 12 onto the tray 11 and completes the formation of the carton.

In accordance with the invention there is located in the center of the side panels 37 and 39 parallel tear lines 55 and 56, respectively. These tear lines join with notches 57 and 58 in the respective side panels to form the tear tabs 59 and 60 positioned to encompass the glue spots 52 and 54, respectively. Across the top center panel 36 and preferably in alignment with the tabs 59 and 60 is formed a fold line 59.

Figure 2:
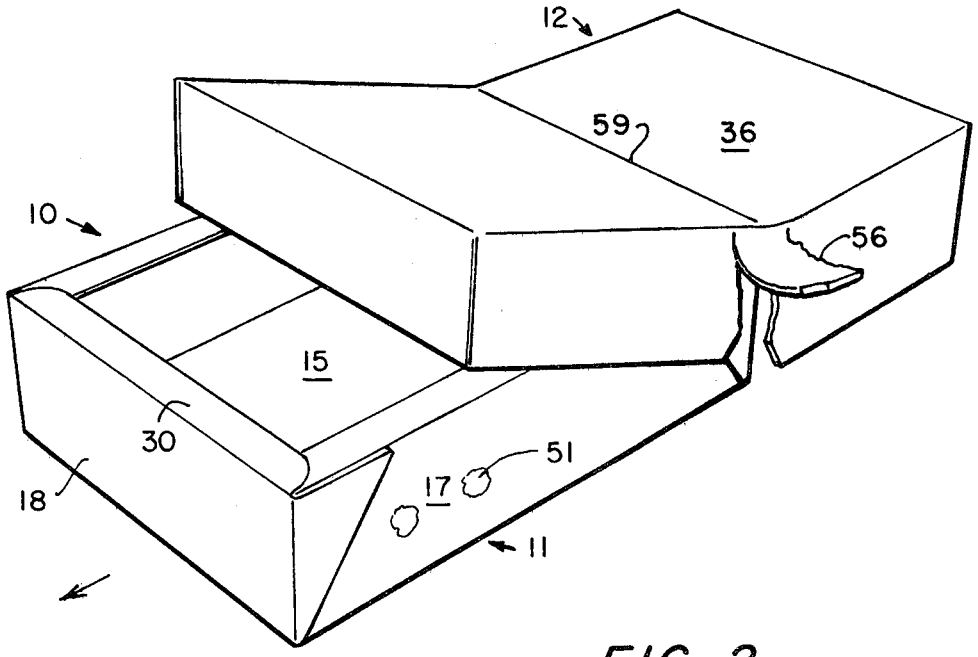
FIG. 2 shows the carton of FIG. 1 with the side tabs pulled up and the top shifted lengthwise on the tray.
Figure 3:
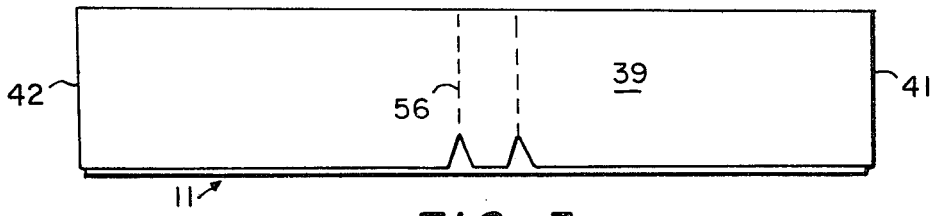
FIG. 3 is a side view of the carton.
Figure 4:
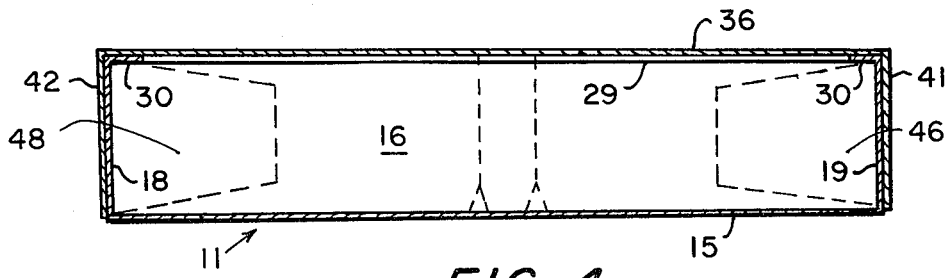
FIG. 4 is a cross-sectional view along the line 4—4 of FIG. 1.

The overall purpose of the tear lines and center fold line on the top center panel is to permit removal of the top without damage to the tray. Since the tray side walls are tapered inward, removal of the top by moving it vertically away from the tray is substantially impossible once it has been formed over the tray. The outward taper of the tray prevents such removal. By tearing the side panels in the manner shown in FIG. 2, i.e. grabbing the lower extending end of the tabs 59 and 60 between the cutouts 57 and 58 and pulling outward and upward, the tear strip is pulled away from the tray side wall and the glued portions are separated. Thereafter the top can be bent along the fold line 59 and since the side panel is now separated into two sections, it will spring outward sufficiently to allow sliding up and over the tapered side wall of the tray. Thereafter the remaining half of the top can be slid lengthwise of the tray for complete removal.

Thus there is provided a novel carton especially adapted for use in baking by provision of the outer tapered side walls on the tray but from which the top can be removed without damage to the tray such that the tray can be used for subsequent baking or cooking.

The invention claimed:

1. A paperboard carbon comprising:

a tray having a bottom panel and upstanding pairs of side walls and end walls having extending edges;

a top for covering said tray comprising a top center panel and pairs of side panels and end panels with the top center panel being sized to fit over the wall edges and said top side and end panels each being positioned to be folded against an adjacent tray wall;

each of said top side panels including hinged flap means to enable a portion of said panels to be torn towards the top panel between and along spaced lines forming said flap; and glue means fixing a portion of said flaps to the adjacent tray wall whereby said top can be fastened to said tray at the flaps by gluing said flaps to the adjacent tray wall and said top can be removed therefrom without damage to the tray by lifting the flaps upwardly between said spaced lines to separate the glued flaps and tray walls without damage to the tray.

2. A carton as defined in claim 1 wherein at least one pair of said tray side walls are tapered away from each other such that the extending wall edges form a larger area than the tray bottom panel.

3. A carton as defined in claim 2 wherein said top center panel includes a fold line.

4. A carton as defined in claim 3 wherein said fold line joins said flaps.

* * * * *